US008992046B2

(12) United States Patent
Moeck et al.

(10) Patent No.: US 8,992,046 B2
(45) Date of Patent: Mar. 31, 2015

(54) LIGHTING DEVICE AND LAMP COMPRISING SAID LIGHTING DEVICE

(75) Inventors: Martin Moeck, Regensburg (DE); Harald Henkel, Hagelstadt-Langenerling (DE); Wilhelm Meierhofer, Sinzing (DE); Jens Florian Hockel, München (DE); Thomas Donauer, Kelheim (DE)

(73) Assignees: OSRAM Opto Semiconductors GmbH, Regensburg (DE); OSRAM GmbH, Munich (DE)

( * ) Notice: Subject to any disclaimer, the term of this patent is extended or adjusted under 35 U.S.C. 154(b) by 505 days.

(21) Appl. No.: 13/262,806

(22) PCT Filed: Apr. 1, 2010

(86) PCT No.: PCT/EP2010/054444

§ 371 (c)(1), (2), (4) Date: Apr. 3, 2012

(87) PCT Pub. No.: WO2010/112595

PCT Pub. Date: Oct. 7, 2010

(65) Prior Publication Data

US 2012/0182732 A1 Jul. 19, 2012

(30) Foreign Application Priority Data

Apr. 3, 2009 (DE) ..... 10 2009 016 231
Jun. 22, 2009 (DE) ..... 10 2009 029 839

(51) Int. Cl.
*F21S 4/00* (2006.01)
*F21V 11/14* (2006.01)
(Continued)

(52) U.S. Cl.
CPC ..... *F21V 11/14* (2013.01); *F21S 8/088* (2013.01); *F21V 19/001* (2013.01);
(Continued)

(58) Field of Classification Search
USPC ..... 362/351–361, 373, 341–342, 362/249.02–249.04, 235
See application file for complete search history.

(56) References Cited

U.S. PATENT DOCUMENTS 1,900,330 A 3/1933 Chartrand
3,748,465 A 7/1973 Murray et al.
(Continued)

FOREIGN PATENT DOCUMENTS

DE 203 08 390 8/2003
DE 102 53 611 6/2004
(Continued)

OTHER PUBLICATIONS http://apps1.eere.energy.gov/buildings/publications/pdfs/ssl/konkle_ss108.pdf, Apr. 2009.
(Continued)

*Primary Examiner* — Sean Gramling
(74) *Attorney, Agent, or Firm* — Cozen O'Connor

(57) ABSTRACT

A luminous means (1) comprising a multiplicity of light emitting diodes (10) arranged in a manner distributed three-dimensionally and a screen (11) formed from a radiation-opaque or translucent material, wherein the screen (11) encloses the light emitting diodes at least in places, wherein the screen (11) has a multiplicity of perforations disposed downstream of the light emitting diodes (10) in the emission direction, and wherein light emitted by the light emitting diodes (10) during operation of the luminous means passes through the perforations (12).

16 Claims, 14 Drawing Sheets

(51) Int. Cl.

| | |
|---|---|
| ***F21S 8/08*** | (2006.01) |
| ***F21V 19/00*** | (2006.01) |
| ***F21V 29/00*** | (2006.01) |
| *F21K 99/00* | (2010.01) |
| *F21V 7/00* | (2006.01) |
| *F21Y 101/02* | (2006.01) |
| *F21Y 111/00* | (2006.01) |

(52) U.S. Cl.

CPC ..... *F21V 29/004* (2013.01); *F21V 29/2206* (2013.01); *F21K 9/00* (2013.01); *F21V 7/0058* (2013.01); *F21Y 2101/02* (2013.01); *F21Y 2111/002* (2013.01)

USPC ..... 362/249.02; 362/235; 362/341; 362/342; 362/351; 362/373

(56) References Cited

U.S. PATENT DOCUMENTS

| | | | | |
|---|---|---|---|---|
| 6,575,591 | B1 | 6/2003 | De Lany | |
| 2008/0062689 | A1 | 3/2008 | Villard | |
| 2008/0092800 | A1 | 4/2008 | Smith et al. | |
| 2009/0016072 | A1 | 1/2009 | Lee et al. | |
| 2009/0027887 | A1 | 1/2009 | Yamada et al. | |
| 2009/0040750 | A1 | 2/2009 | Myer | |
| 2009/0213592 | A1 * | 8/2009 | Zhang et al. | 362/249.02 |
| 2009/0244900 | A1 * | 10/2009 | Chang et al. | 362/294 |

FOREIGN PATENT DOCUMENTS

| | | | | |
|---|---|---|---|---|
| DE | 10 2007 002 839 | | 3/2008 | |
| DE | 20 2008 013 495 | | 2/2009 | |
| DE | 20 2008 015 080 | | 2/2009 | |
| EP | 2 138 758 | | 6/2008 | |
| EP | 2 014 970 | | 1/2009 | |
| EP | 2 138 758 | | 12/2009 | |
| JP | 10-144113 | | 5/1998 | |
| WO | WO 2004/070266 | | 8/2004 | |
| WO | WO 2004070266 | A1 * | 8/2004 | F21V 17/06 |
| WO | WO 2007/097281 | | 8/2007 | |

OTHER PUBLICATIONS http://apps1.eere.energy.gov/buildings/publications/pdfs/ssl/workshop_report08.pdf, Apr. 2009.

http://www.rp-online.de/public/article/duesseldorfstadt/505517/LED-Leuchten-senken-Kohlendioxid-Ausstoss.html, Nov. 2007.

http://www.rp-online.de/public/article/duesseldorf-stadt/507209/Erste-LED-Strassenbeleuchtungin-Dusseldorf.html, Nov. 2007.

http://www.1eere.energy.gov/buildings/ssl/gatewaydemos_results.html, Apr. 2009.

* cited by examiner

LIGHTING DEVICE AND LAMP COMPRISING SAID LIGHTING DEVICE

RELATED APPLICATIONS

This is a U.S. national stage of application No. PCT/EP2010/054444, filed on Apr. 1, 2010.

This patent application claims the priority of German patent applications 102009016231.3 filed Apr. 3, 2009 and 102009029839.8 filed Jun. 22, 2009, the disclosure contents of both of which are hereby incorporated by reference.

BACKGROUND OF THE INVENTION

A luminous means is specified. Furthermore, a luminaire (colloquially also called "lamp") is specified in which such a luminous means is used as a light source.

The document US 2008/0092800 A1 describes a luminous means.

SUMMARY OF THE INVENTION

An object to be achieved is to specify a luminous means which has improved optical properties.

In accordance with at least one embodiment of the luminous means, the luminous means comprises a multiplicity of light emitting diodes. The light emitting diodes are suitable for emitting light during operation. The light emitting diodes thus form the light-generating elements of the luminous means. The luminous means comprises, for example, at least three light emitting diodes and, for example, a maximum of 48 light emitting diodes.

In accordance with at least one embodiment of the luminous means, the light emitting diodes of the luminous means are arranged in a manner distributed three-dimensionally. That means, in particular, that the light emitting diodes of the luminous means are not arranged along a single line and are not arranged in a single common plane. Rather, the light emitting diodes are distributed spatially in such a way that no line on which all the light emitting diodes of the luminous means are arranged can be found, and that no plane in which all the light emitting diodes of the luminous means are arranged can be found. With a multiplicity of light emitting diodes arranged in a manner distributed three-dimensionally, it is possible to set the illuminance distribution of the luminous means in different spatial directions independently of one another. It is therefore possible for the luminous means to emit different quantities of luminous flux in different spatial directions.

In accordance with at least one embodiment of the luminous means, the luminous means comprises a screen. The screen is formed from a radiation-opaque material, which is radiation-opaque in particular to the light emitted by the light emitting diodes. By way of example, that side of the screen which faces the light emitting diodes can be embodied as radiation-absorbing or radiation-reflecting. Furthermore, it is possible for the screen to be embodied as translucent, that is to say radiation-transmissive and opalescent. The transmission is then at least 50%, for example at least 80% or at least 90%.

The screen encloses the light emitting diodes at least in places. By way of example, the form of the screen corresponds to the form of the lateral surface of a three-dimensional hollow body. The screen can therefore have the form of the lateral surface of a cube, of a cone, of a truncated cone, of a pyramid, of a truncated pyramid, of a sphere, of an ellipsoid or the like. The light emitting diodes are arranged in the interior of the hollow body, such that the screen—that is to say the lateral surface of the hollow body—laterally encloses the light emitting diodes. In this case, the screen can have at its top side and at its underside a cover plate and a base plate, respectively, which can be embodied as radiation-transmissive, radiation-reflecting or radiation-opaque.

In accordance with at least one embodiment of the luminous means, the screen comprises a multiplicity of perforations. The perforations are openings in the screen in which the radiation-opaque material of the screen has been removed. The perforations are disposed downstream of the light emitting diodes of the luminous means in the emission direction. That is to say that, during operation of the luminous means, light emitted by the light emitting diodes can pass through the perforations. In this case, the light from the light emitting diodes leaves the screen preferably principally or only through the perforations of the screen. Where there are no perforations in the screen, the light from the light emitting diodes is absorbed, partly transmitted or reflected by the screen.

In accordance with at least one embodiment of the luminous means, the luminous means comprises a multiplicity of light emitting diodes arranged in a manner distributed three-dimensionally. The luminous means furthermore comprises a screen formed from a radiation-opaque or translucent material, wherein the screen encloses the light emitting diodes at least in places. The screen has a multiplicity of perforations disposed downstream of the light emitting diodes in the emission direction. In this case, light emitted by the light emitting diodes during operation of the luminous means passes through the perforations of the screen.

In this case, the screen can ensure that the light emitting diodes and other elements of the luminous means are not directly visible from outside the luminous means. That is to say that, for instance, the light emitting diodes, connection carriers for the light emitting diodes, cables for making electrical contact with the light emitting diodes, optical elements and drive circuits are not visible and/or at least not recognizable from outside.

Furthermore, the screen protects the enclosed elements of the luminous means, that is to say the light emitting diodes, for example, mechanically against external influences.

Furthermore, the fact that the light from the light emitting diodes leaves the screen largely through the perforations, for example, reduces the dazzling of persons, for example, by the luminous means. That is to say that the luminous means can be distinguished by a reduced dazzle effect.

Furthermore, through the targeted selection of the places at which the perforations are introduced into the screen, the light distribution of the luminous means can be individually set in a simple manner. By way of example, the screen can have a greater density of perforations in regions at which a particularly large amount of light is intended to emerge from the luminous means than in regions in which less light is intended to emerge from the luminous means. Accordingly, the number of light emitting diodes can be higher in the regions in which more light is intended to be emitted than in other regions. On account of the perforations in the screen, therefore, the luminous means has a reduced light exit area optimized to the requirements.

In accordance with at least one embodiment of the luminous means, the light emitting diodes are arranged at a distance from the screen. That is to say that a free space is situated between the light emitting diodes and the screen, which free space can be filled with air, for example. That is to say, in other words, the light emitting diodes are not in direct contact with the screen. In this case, the distance can be set depending on the desired light distribution. The light emitting diodes can be cooled by means of convection particularly well as a result of air entering into and exiting from the screen.

In accordance with at least one embodiment of the luminous means, a light emitting diode is assigned to each perforation in the screen. By way of example, a light emitting diode is assigned one-to-one to each perforation. That is to say that each light emitting diode is then assigned exactly one perforation through which a large part—for example at least 40%, preferably at least 50%—of the light emitted by the light emitting diode during operation passes. Less, preferably hardly any light emitted by said light emitting diode then passes through other perforations of the screen.

In accordance with at least one embodiment of the luminous means, each perforation has an area content of at most 3 cm2. Preferably, the area content is at most 1.5 cm2, particularly preferably at most 0.5 cm2. On account of the small area content of the perforation, the solid angle of the light passing through the perforation is reduced.

In accordance with at least one embodiment of the luminous means, the distance between mutually adjacent perforations measured on the outer area of the screen facing away from the light emitting diodes is at least 0.5 cm. Preferably, the distance is at least 1 cm, particularly preferably at least 1.5 cm. The wide hole spacing likewise minimizes the dazzling effect caused by the light generated by the luminous means during operation. The use of a lens for concentrating the light through the perforation is possible in this case.

Through a suitable choice of the area of each perforation of the screen and the distance between mutually adjacent perforations, the light exit area of the luminous means can be reduced.

In accordance with at least one embodiment of the luminous means, the perforations are embodied as a circular or square opening. The perforations can then be produced in a particularly simple manner by drilling or stamping in the material of the screen.

In accordance with at least one embodiment of the luminous means, the perforations are embodied as openings having a main extension direction. That is to say that, in comparison with openings not having a main extension direction, the perforations are stretched in one direction and compressed in another direction. In this case, the perforations can be embodied for example as slots, rectangles or in oval fashion.

In this case, it is possible for all the perforations of the screen to be embodied identically with regard to their area content and their form. However, it is also possible that the perforations can have mutually different area contents and different forms depending on their location on the screen. As a result, by way of example, the light distribution of the light emitted by the luminous means during operation can be set in a targeted manner.

In accordance with at least one embodiment of the luminous means, the luminous means comprises at least one heat sink having at least two mounting areas, wherein a light emitting diode is arranged at each mounting area and the mounting areas are arranged in different planes. The heat sink is a metallic body, for example. The heat sink has planar areas provided as mounting areas for light emitting diodes of the luminous means. By way of example, a connection carrier or a circuit board following the form of the heat sink in places can be applied to the heat sink. In the region of the mounting areas of the heat sink, light emitting diodes are then mounted on the circuit board and can be electrically connected via the circuit board. The mounting areas are arranged for example in different planes of the heat sink. It can thereby be ensured that light emitting diodes which are arranged on different mounting planes of a heat sink are not arranged in one and the same plane. In this way, the light emitting diodes of the luminous means can be arranged in a manner distributed three-dimensionally in a simple way.

In accordance with at least one embodiment of the luminous means, the at least one heat sink has at least one side area. In this case, it is possible for the heat sink to have exactly one side area. The side area is then formed for example at least in places by the lateral surface of a sphere, of a cylinder, of a cone or of a truncated cone.

Alternatively, it is possible for the heat sink to have a plurality of side areas, for example three or more side areas. In this case, the side areas can be embodied in flat fashion, that is to say without curvature within the scope of production tolerance. In a plan view of the heat sink, the side areas can form for example a regular or an irregular n-gon, where $n \geq 3$.

The heat sink can consist of the side areas. In this case, the heat sink has no base area and no cover area to which the side areas are fixed. In this case, the side areas are mechanically interconnected and are not held together mechanically by a base area or a cover area.

In accordance with at least one embodiment of the luminous means, the at least one side area comprises the mounting areas of the heat sink. In the region of the mounting areas, the light emitting diodes of the luminous means are at least indirectly fixed to the side areas of the heat sink. Here, for the case where the heat sink comprises more than one side area, each side area can comprise exactly one mounting area or a plurality of mounting areas.

In accordance with at least one embodiment of the luminous means, at least one connection carrier facing the screen of the luminous means is fixed to each side area of the heat sink or each side area comprises a connection carrier, that is to say is formed for example by a connection carrier.

The connection carrier is fixed to a side area of the heat sink for example in the region of a mounting area. The connection carrier can be adhesively bonded onto the side area, soldered onto the side area or it is fixed to the side area by a mechanical fixing means such as at least one rivet or at least one screw.

Preferably, the side area and the connection carrier have a largest possible connection area in which the connection carrier is in direct contact with the side area to which it is applied. By way of example, the connection area can be at least 90% of the basic area of the connection carrier.

The connection carrier is a circuit board, for example. That is to say that the connection carrier has a basic body into which or onto which electrical connection locations and conductor tracks are structured. By way of example, the connection carrier is a printed circuit board, a metal-core circuit board or a ceramic carrier metalized in places.

In accordance with at least one embodiment of the luminous means, at least one light emitting diode is mechanically fixed and electrically connected to each connection carrier. In this case, the light emitting diode is mechanically fixed and electrically connected to the connection carrier on the side remote from the side area of the heat sink on which the connection carrier is fixed. That is to say that the light emitting diode fixed on the connection carrier or the light emitting diodes fixed on the connection carrier face(s) the screen.

During operation of the light emitting diodes, a large part of the generated heat is emitted from the light emitting diodes to the connection carrier and from the connection carrier to the assigned side area of the heat sink. From there, the heat can be dissipated from the heat sink by thermal conduction and/or convection. For this purpose, the side areas preferably enclose a volume through which air for cooling purposes can flow.

In accordance with at least one embodiment of the luminous means, the luminous means comprises at least one heat sink having at least one side area. The at least one side area comprises the mounting areas of the heat sink. At least one connection carrier facing, the screen is fixed to each side area of the heat sink, or each side area is formed by a connection carrier and at least one light emitting diode is mechanically fixed and electrically connected to each connection carrier.

In accordance with at least one embodiment of the luminous means, the at least one side area encloses a volume in which a ballast for operating at least one portion of the light emitting diodes is arranged. By way of example, the ballast can be fixed to that side of the at least one side area of the heat sink which is remote from the connection carrier. In this case, it is possible for the luminous means to comprise exactly one ballast for operating all the light emitting diodes of the luminous means. Furthermore, it is also possible, for example, for exactly one ballast to be present in the luminous means for each connection carrier and/or for each side area of the heat sink. In this case, by way of example, the light emitting diodes of different connection carriers can be operated independently of one another. As a result, it is possible to set a spatially asymmetrical light intensity distribution of the light emitted by the luminous means, in which, by way of example, the totality of the light emitting diodes of one connection carrier generate light having a lower luminous flux than light generated by the totality of the light emitting diodes of another connection carrier of the luminous means.

The ballast is, for example, an electronic ballast which provides the voltage necessary for operating the light emitting diodes. Furthermore, the ballast can comprise further components for driving the light emitting diodes, such as a pulse width modulation circuit, for example. Alternatively or additionally it is also possible for the volume enclosed by the at least one side area to contain one or a plurality of further drive devices, which can comprise, for example, at least one pulse width modulation circuit, at least one microcontroller and/or at least one constant-current source.

In accordance with at least one embodiment of the luminous means, the at least one heat sink has a base area, to which the at least one side area of the heat sink is fixed. That is to say that the base area terminates the volume enclosed by the at least one side area at one side of the heat sink. In this case, the base area and/or the at least one side area can have openings through which air can penetrate into the volume, thereby enabling convection through the enclosed volume.

The base area can form that element of the heat sink which mechanically stabilizes the at least one side area of the heat sink and, in the case of a plurality of side areas, connects them to one another. Furthermore, the base area of the heat sink can serve as a carrier for further components of the luminous means such as the ballast or ballasts.

In accordance with at least one embodiment of the luminous means, the base area has at least one first cutout, wherein at least one side area of the heat sink projects into the at least one first cutout in places. By way of example, the number of cutouts in the base area can correspond to the number of side areas. Each of the side areas then projects into the assigned first cutout in places.

The first cutout is, for example, a groove in the base area at the side of the base area which faces the at least one side area. The at least one first cutout can completely penetrate through the base area. A side area which projects into the cutout in places can be connected to the base area by a press fit mechanically by pressing into the cutout. Furthermore, it is possible for the side area to be connected to the base area loosely in the region of the cutout and for the cutout to serve merely for fixing the side area, wherein a certain play for setting an angle of inclination between base area and side area remains present.

In accordance with at least one embodiment of the luminous means, the base area has at least one second cutout, wherein the second cutout is arranged at that side of the first cutout which faces the screen. The base area then preferably has the same number of first and second cutouts. The second cutout is provided for receiving an optical module. That is to say that an optical module can project into the second cutout in places and can be fixed to the base area by means of the second cutout or can be fixed to the base area with a certain latitude for setting the angle of inclination. The optical module in the second cutout is disposed downstream of the side area in the first cutout in the emission direction of the light emitting diodes, such that at least part of the light generated by the light emitting diodes during operation passes through the optical module. The optical module can be a carrier plate, for example, on which an optical lens is provided for each light emitting diode, said optical lens serving for the beam shaping of the light generated by the light emitting diodes during operation. Furthermore, the optical module can be a diffusing plate provided for diffusely scattering light generated by the light emitting diodes during operation. In this case, it is also possible for the optical plate to be a part of the screen or the screen of the luminous means.

In accordance with at least one embodiment of the luminous means, the side areas among one another and/or the side areas and the base areas are mechanically connected to one another releasably. That is to say that by exerting a mechanical force, it is possible to release the connection between the side areas among one another and/or between the side areas and the base area, without a component of the luminous means being destroyed in the process. As a result, it is possible, for example, to remove a side area with a connection carrier applied to the side area from the luminous means and to replace it by a new side area with connection carrier. In this way, maintenance of the luminous means is possible in a particularly simple manner.

In accordance with at least one embodiment of the luminous means, the at least one side area and the base area are connected to one another via a hinge. The hinge makes it possible that the angle formed by the base area and the side area with one another can be set. In this way, the emission direction of the light emitting diodes fixed to the side area can be set in a particularly simple manner. In this case, the luminous means preferably comprises a plurality of side areas each connected to the base area via a hinge, such that the emission direction of the light emitting diodes of different side areas can be set individually, that is to say substantially independently of the other side areas.

In accordance with at least one embodiment of the luminous means, the heat sink is embodied in integral fashion. That is to say that the side areas and, if appropriate, the side areas and the base area are embodied in integral fashion.

Such a heat sink can be manufactured from a plastic for example by means of an injection molding method or a transfer molding method. Therefore, the heat sink is then injection-molded or transfer-molded. In this case, "injection-molded" and "transfer-molded" are substantive features that can be demonstrated on the finished product for example by means of residues, such as burrs, that are typical of the production methods. Furthermore, it is possible for the components of the heat sink to be stamped or cut from a metal plate, for example a metal sheet. In this case, too, the heat sink is embodied in integral fashion.

In accordance with at least one embodiment of the luminous means, at least two of the side areas of the heat sink form mutually different angles with the base area of the heat sink. Alternatively, if the heat sink does not comprise a base area, at least two of the side areas form mutually different angles with an imaginary base area that delimits the volume enclosed by the side areas at one side of the heat sink.

By virtue of the different angles, the light emitting diodes arranged on the side areas have, for example, different emission directions in a vertical direction running perpendicular to the base area. In this way, it is possible for the luminous means to have an asymmetrical light intensity distribution which is not rotationally symmetrical with respect to an axis perpendicular to the base area. If the heat sink is embodied in integral fashion, the different inclination of the side areas can already be set during the production of the heat sink. If the side areas are connected to the base area in a movable manner relative to the base area by means of a hinge, for example, the angle can also be set at the site of use of the luminous means.

In accordance with at least one embodiment of the luminous means, at least one of the heat sinks has a staircase-like profile in a cross section—for example along the main extension direction of the heat sink. The mounting areas of the heat sink are formed by the treads of the staircase-like profile. Light emitting diodes are then arranged in different planes at the mounting areas. In this case, it is possible for the mounting areas—that is to say, for example, the treads of the staircase-like profile—not to be arranged parallel to one another, contrary to a customary staircase. Rather, it is possible for the mounting areas to be inclined with respect to one another, such that light emitting diodes arranged at different mounting areas of the heat sink have main emission directions that do not run parallel to one another.

In accordance with at least one embodiment of the luminous means, the luminous means comprises a cover plate, which is connected to the screen at a top side of the screen. Furthermore, the luminous means comprises a base plate, which is connected to the screen at an underside of the screen remote from the top side. Cover plate and base plate have at least one opening in each case through which air can pass during the operation of the luminous means. During operation of the luminous means, that is to say during operation of at least one portion of the light emitting diodes of the luminous means, heat is generated by the light emitting diodes. Said heat generates a convection in the luminous means. As a result, air passes through the openings in cover plate and base plate and also through the perforations of the screen. Said air in turn serves for cooling the light emitting diodes of the luminous means. That is to say that the light emitting diodes of the luminous means are convection-cooled, wherein both the perforations and the openings in the cover plate and the base plate allow circulation of air through the luminous means.

In accordance with at least one embodiment of the luminous means, cover plate and/or base plate are connected to the screen mechanically releasably. By way of example, cover plate and base plate can be connected to one another by a press fit and/or a screw connection. Here and hereinafter "mechanically releasably" means that the connection can be released in a nondestructive manner by mechanical force action. That is to say that the connection can be released without a component being destroyed. This contributes to the fact that the luminous means—for example in the event to damage to one or more light emitting diodes—can be opened in a simple way in order to exchange the defective elements.

In accordance with at least one embodiment of the luminous means, the luminous means comprises a base, which is arranged between the cover plate and the base plate and which is fixed to the base plate. At least one of the heat sinks, on which light emitting diodes of the luminous means are arranged, is mechanically releasably connected to the base and the cover plate. The base therefore serves for receiving and fixing at least one, for example all heat sinks of the luminous means. In this case, the base can also be embodied integrally with the base plate of the luminous means. The heat sink is then mechanically releasably fixed to base and cover plate, such that it can be released from base and cover plate in a nondestructive manner under mechanical force action, in order, by way of example, to exchange the entire heat sink with the light emitting diodes arranged thereon. Furthermore, by way of the number of heat sinks it is possible, in a simple manner, to set the number of light emitting diodes of the luminous means, such that, by simple mechanical fixing or mechanical release of heat sinks, the number of light emitting diodes of the luminous means can be set in accordance with the requirements made of the luminous means.

In accordance with at least one embodiment of the luminous means, the luminous means comprises a multiplicity of heat sinks, wherein at least two light emitting diodes are fixed to each heat sink. All the heat sinks are mechanically releasably fixed—for example screwed, clipped or pressed—to the base and to the cover plate, for example. By way of the number of heat sinks fixed in the luminous means, it is possible to set the light distribution and also the brightness of the light generated by the luminous means in a simple manner.

In accordance with at least one embodiment of the luminous means, the emission angle of at least one of the light emitting diodes is adjustable. This can be achieved, for example, by setting the angle of inclination of the light emitting diodes relative to the screen by bending or deforming the circuit board or the heat sink on which the light emitting diode is arranged. By way of example, the illuminance distribution of the light from the luminous means which is directed at the ground or into planes parallel to the ground can thus be set in a variable manner. In particular, it is possible for different light emitting diodes of the luminous means to emit their light in different directions. Thus, by way of example, a first group of light emitting diodes of the luminous means can be provided for illuminating a predetermined region of the ground. Another group of light emitting diodes can be provided for illuminating a region remote from the ground, for example a building. In other words, on account of the three-dimensional distribution of the light emitting diodes, the luminous means has an illuminance distribution that is direction-dependent.

Such a luminous means can be used in a luminaire, for example. The luminaire can be a street light, for example. With the luminous means described, the roadway of the street can be illuminated for example with the light emitting diodes of the luminous means which face the street. By way of example, a building can be illuminated with light emitting diodes of the luminous means which face away from the street.

BRIEF DESCRIPTION OF THE DRAWINGS

A luminaire described here is described in greater detail with reference to the schematic side view in FIG. 1.

A luminous means described here is explained in greater detail with reference to the schematic illustrations in FIGS. 2, 3A, 3B, 3C, 3D, 3E, 4A, 4B, 4C.

A luminaire described here is explained in greater detail with reference to FIGS. 5A, 5B.

Further luminous means described here are explained in greater detail with reference to the schematic illustrations in FIGS. 6, 7, 8A, 8B, 8C.

Figure 9:
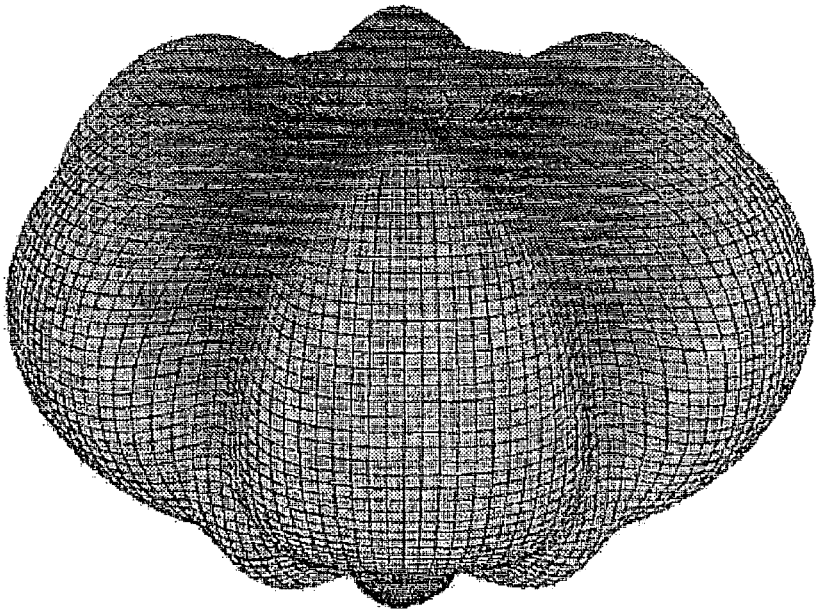

FIG. 9 schematically shows the light intensity distribution for a luminous means described here.

DETAILED DESCRIPTION OF THE DRAWINGS

Elements which are identical, of identical type or act identically are provided with the same reference symbols in the figures. The figures and the size relationships of the elements illustrated in the figures among one another should not be regarded as to scale. Rather, individual elements can be illustrated with an exaggerated size in order to enable better illustration and/or in order to afford a better understanding.

Figure 1:
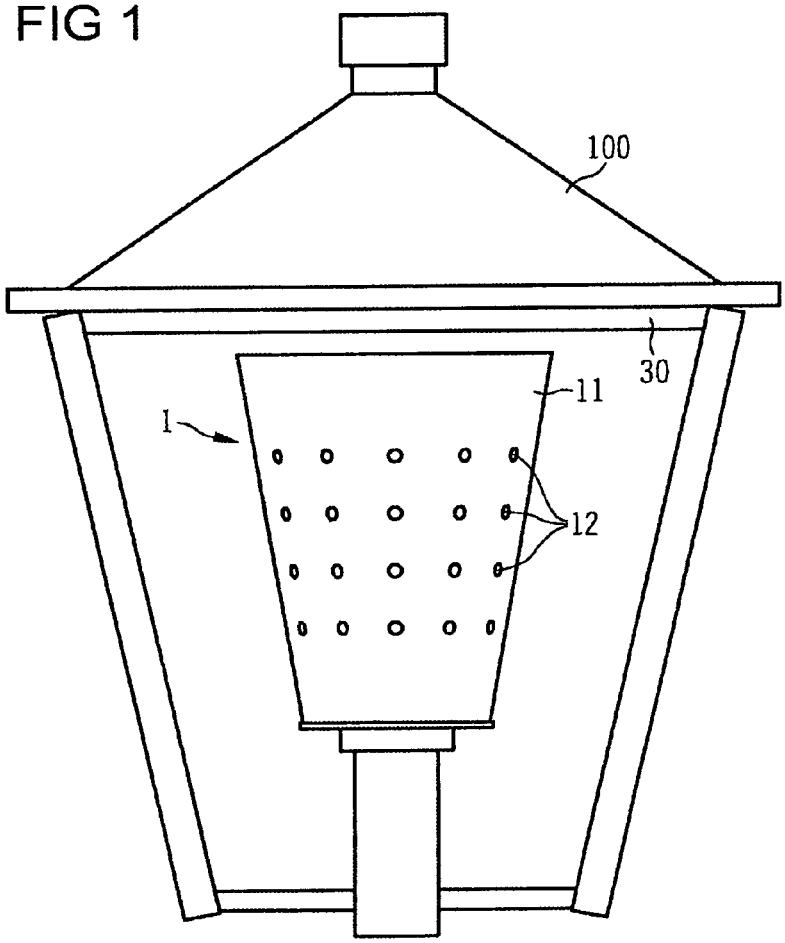

FIG. 1 shows a schematic side view of a luminaire 100 described here. The luminaire 100 is a street light, for example. The luminaire 100 comprises the luminous means 1 as a light source. In the luminous means 1, only the screen 11 is visible in the side view, said screen having perforations 12 through which light generated by the luminous means can pass out of the luminous means. The luminaire 100 comprises, alongside the luminous means 1, a cover plate 30, for example, on which drive circuits for the luminous means 1 can be arranged.

Figure 2:
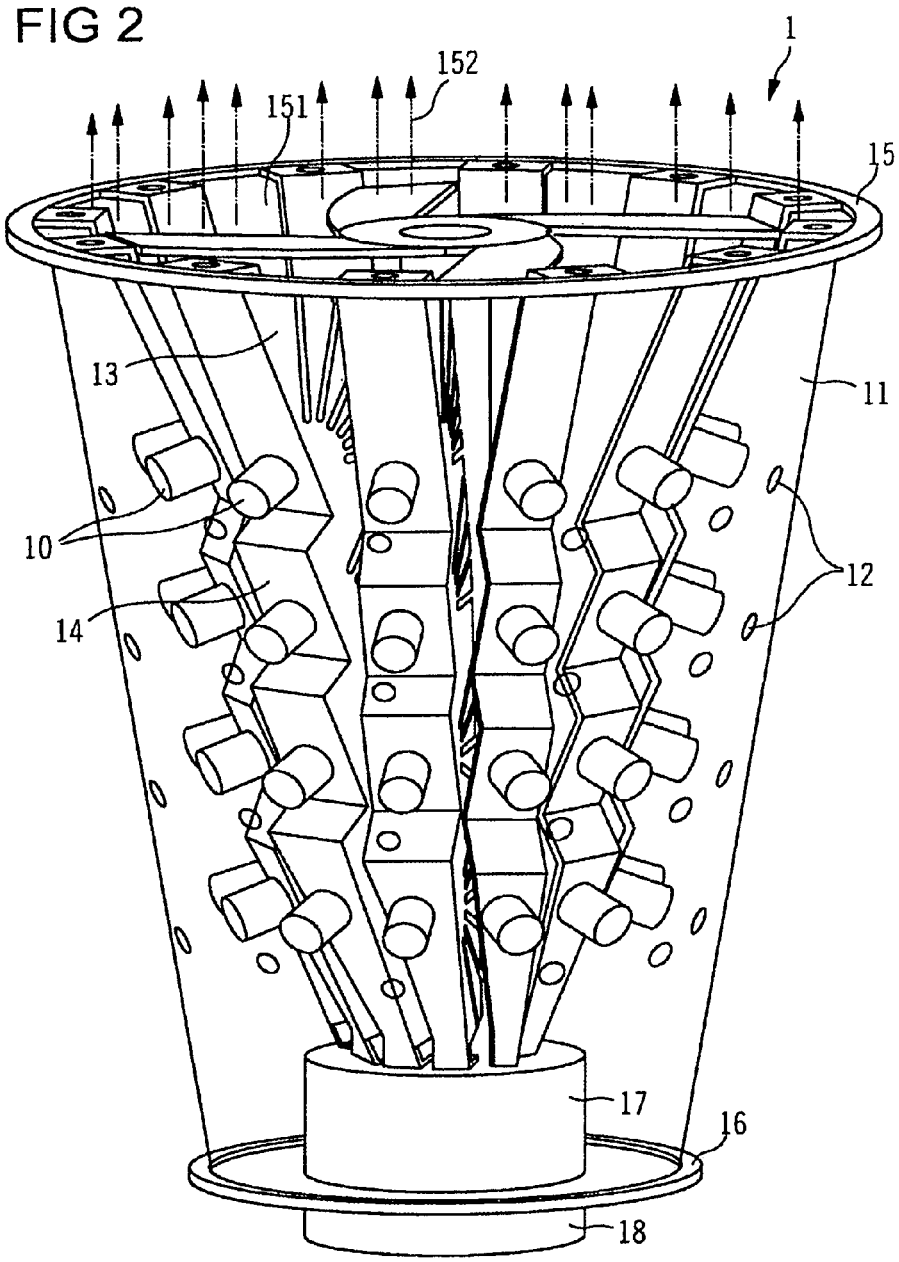

FIG. 2 shows a luminous means 1 described here on the basis of a schematic perspective illustration. The luminous means 1 comprise a multiplicity of light emitting diodes 10. The light emitting diodes 10 are arranged in a manner distributed three-dimensionally. For this purpose, the light emitting diodes 10 are arranged on mounting areas 14 of heat sinks 13 embodied in a staircase-like fashion. The heat sinks 13 in each case run from a base 17 of the luminous means 1 to the cover plate 15 of the luminous means 1. The heat sinks 13 are in each case screwed or pressed to base 17 and cover 15, for example.

The base 17 is arranged on a base plate 16, which terminates the luminous means at its underside. Arranged on that side of the base plate 16 which is remote from the base there is a pick-up device 18, which can be used to fix the luminous means for example in the luminaire illustrated in conjunction with FIG. 1. However, the luminous means can also be suspended in the luminaire. That is to say that the luminous means can be fixed at its top side and/or at its underside in the luminaire. Furthermore, it is possible for the luminous means to be arranged in a height-adjustable manner in the luminaire.

The luminous means 1 furthermore comprises the screen 11. The screen 11 has the form of the lateral surface of a three-dimensional body such as a cube, a cone, a truncated cone, a truncated cylinder, a sphere or a cylinder. In the present case, the screen 11 has the form of the lateral surface of a truncated cylinder. The screen 11 is formed from a radiation-absorbing material. By way of example, the screen 11 can consist of a metal.

The screen 11 is then formed from a metal sheet, for example. Perforations 12 are arranged in the screen 11, said perforations being embodied as circular holes in the present case. Light generated by the light emitting diodes 10 during operation of the luminous means passes toward the outside through the perforations 12. In this case, at least one perforation 12 can be disposed downstream of each light emitting diode 10 in the emission direction. In this case, the light emitting diodes 10 are arranged at a distance from the screen 11, such that part of the light generated by the light emitting diodes 10 does not impinge on the perforation 12, but rather on the screen 11, where it is absorbed or reflected.

During operation of the light emitting diodes 10, the latter generate heat which leads to the circulation of air 152 through the luminous means 1. The air can enter into the luminous means 1 for example through the perforations 12 and openings in the base plate 16 and can leave said luminous means through openings 151 in the cover plate.

Figure 3A:
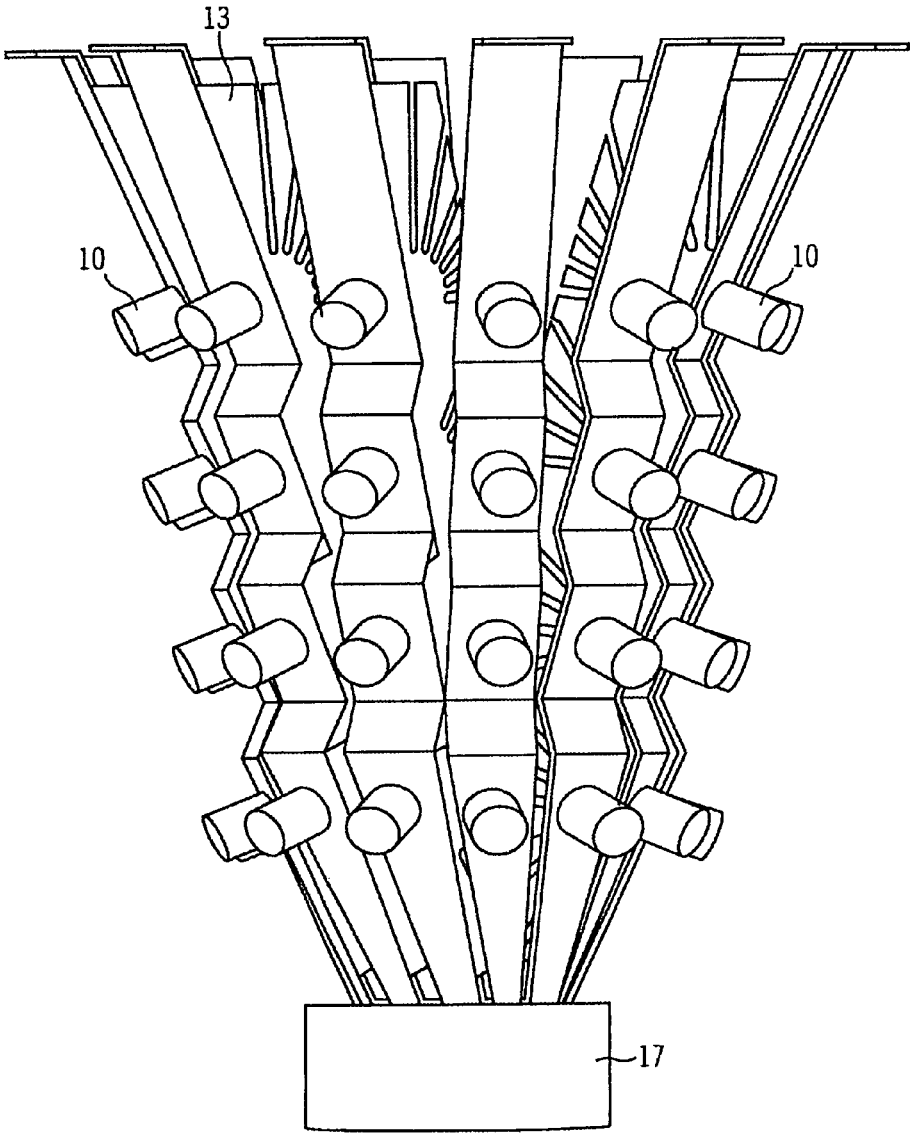

FIG. 3A shows a schematic perspective illustration of a luminous means 1 described here without cover plate, base plate and screen. As can be gathered from FIG. 3A, the heat sinks 13 run from the base 17 in a fan-like manner for example along a circle. By way of the number of the heat sinks 13 fixed to the base 17, it is possible to set the number of light emitting diodes 10 of the luminous means.

Figure 3B:
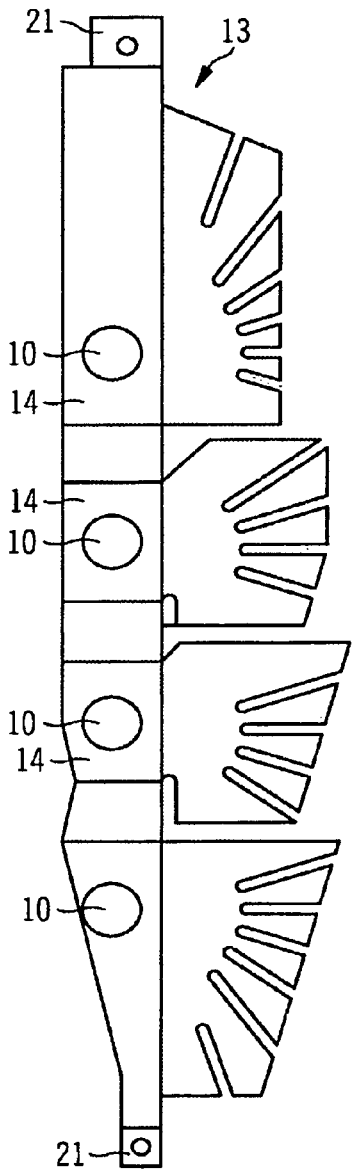
Figure 3C:
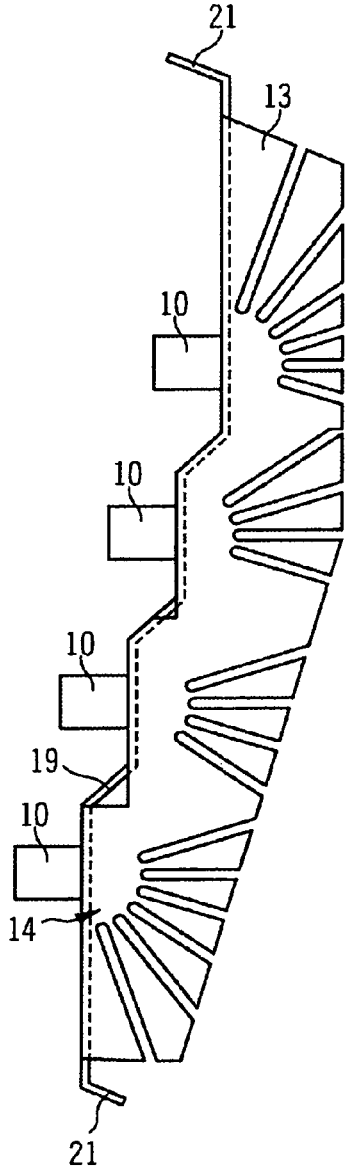

FIGS. 3B and 3C show a schematic plan view and a schematic side illustration, respectively, of a heat sink 13 of the luminous means 1. As is evident from FIG. 3C, in particular, the heat sink 13 has mounting areas 14. The heat sink 13 comprises a staircase-like profile, wherein the mounting areas 14 form the treads of the profile. Different light emitting diodes 10 that are arranged on different mounting areas 14 are therefore arranged in planes offset with respect to one another. By way of example, the emission direction of the light emitting diodes 10 can be set by way of the orientation of the heat sink 13 in the luminous means. Said orientation can be set for example by bending the fixing lugs 21 via which the heat sink is fixed to the base 17 and to the cover plate 15.

Figure 3D:
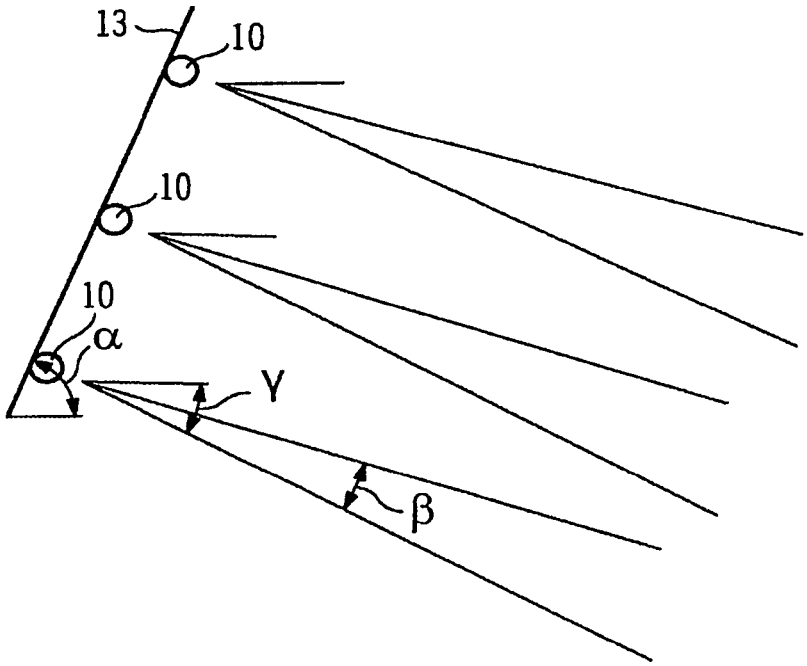

As a result, it is thus possible to set the angle $\alpha$ of inclination of the heat sink in the luminous means (in this respect see FIG. 3D). The light emitting diodes 10 themselves have an emission angle range $\beta$ in which they emit a large part of the light emitted by them. For example by bending circuit boards 19 which are arranged at the heat sink 13 and via which electrical contact is made with the light emitting diodes 10, the emission direction of the light emitting diodes can be set further in the angle range y.

In this case, the light emitting diodes 10 can have optical elements which focuses the light generated by them onto the perforations 12 in the screen, such that hardly any light impinges on the inner side of the screen assigned to the light emitting diodes 10 and is absorbed or reflected there. The optical element assigned to a light emitting diode 10 can be, for example, a lens and/or a reflector. Through the perforations which form the light exit areas of the luminous means, the desired light distribution of the light emitted by the luminous means is set.

Figure 3E:
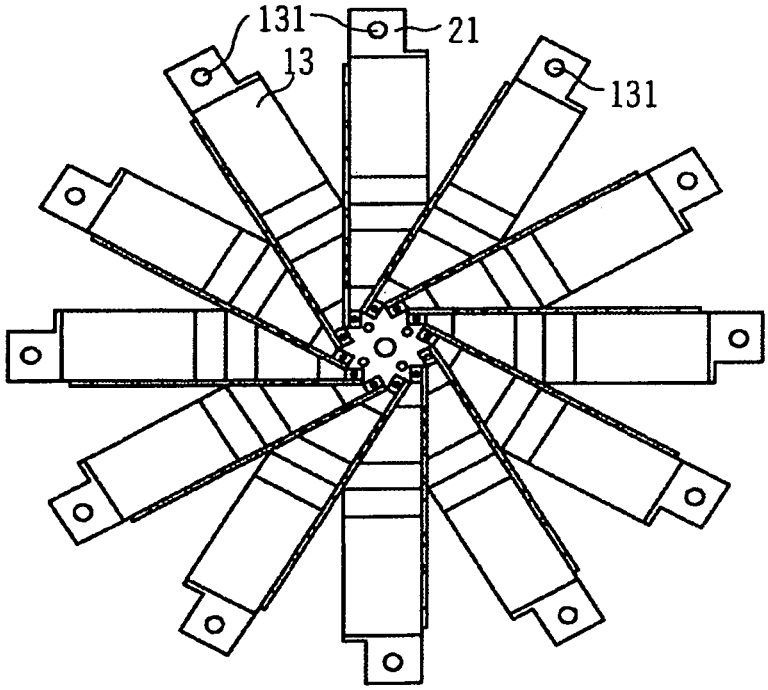

FIG. 3E shows a schematic plan view of the heat sinks 13 fixed to the base 17. In this case, it can be discerned that each heat sink 13 has a fixing lug 21, having an opening 131, provided for receiving a screw, for example. In this case, the heat sinks 13 can be screwed to the cover plate 15 of the luminous means 1.

Figure 4A:
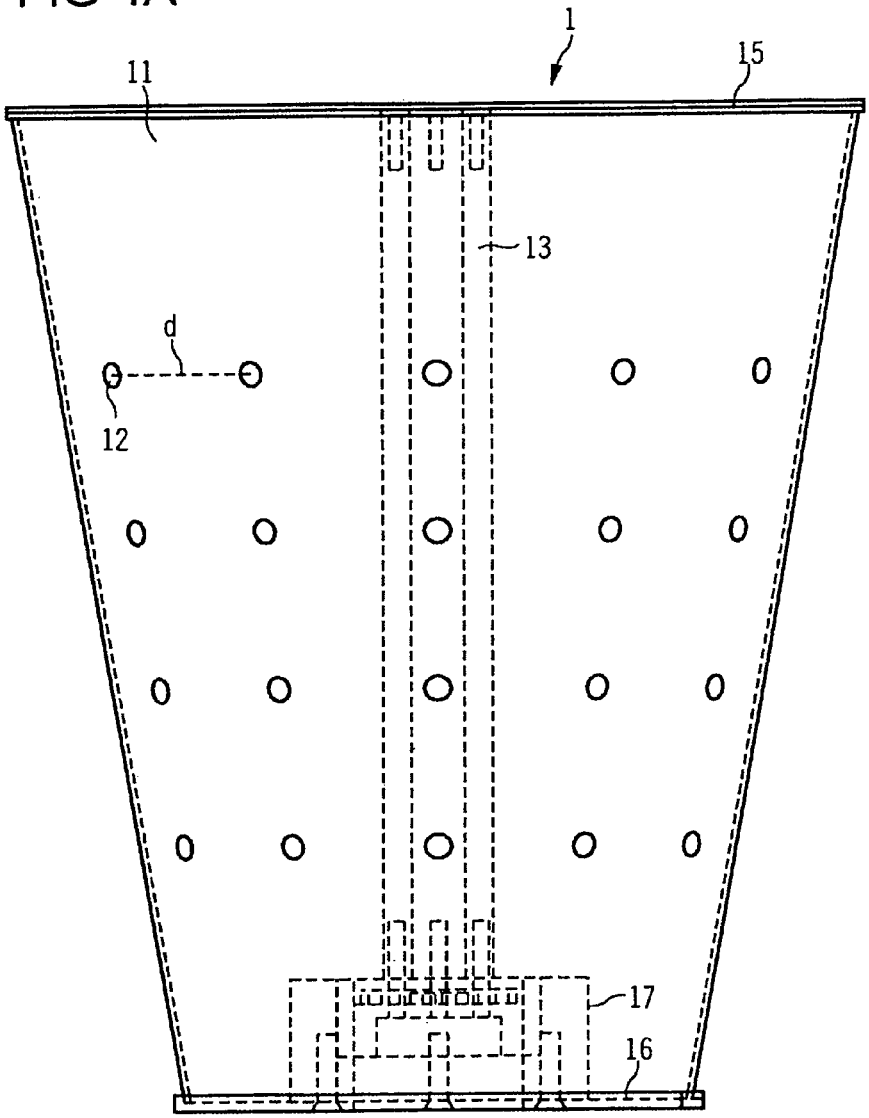
Figure 4B:
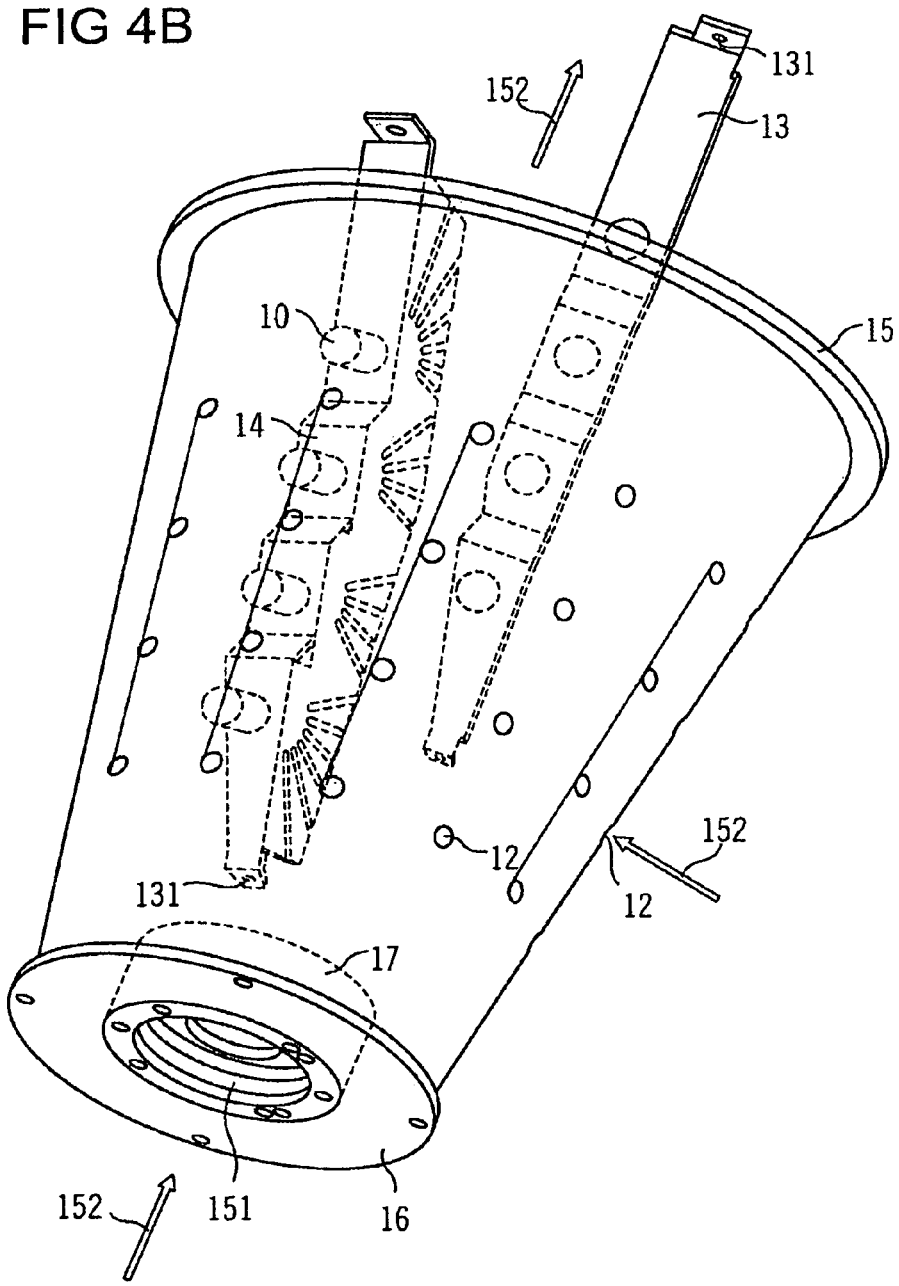

FIG. 4A shows a schematic side illustration of a luminous means 1 described here with screen 11, base plate 16 and cover plate 15. In this case, base plate 16 and cover plate 15 can be mechanically releasably connected to the screen 11. The heat sinks 13 with the light emitting diodes 10 are mechanically releasably fixed; for example screwed, to the base 17 and the cover plate 15. The number of light emitting diodes per heat sink 13 and the number of heat sinks 13 determine the quantity of light that can be generated by the luminous means during operation. Through openings 151 in the base plate 16 (in this respect, also see FIG. 4B) and through the perforations 12, air 152 can pass into the luminous means during operation of the light emitting diodes 10, which air, after being heated by the light emitting diodes 10, escapes from the luminous means 1 again through openings 151 in the cover plate 15.

Figure 4C:
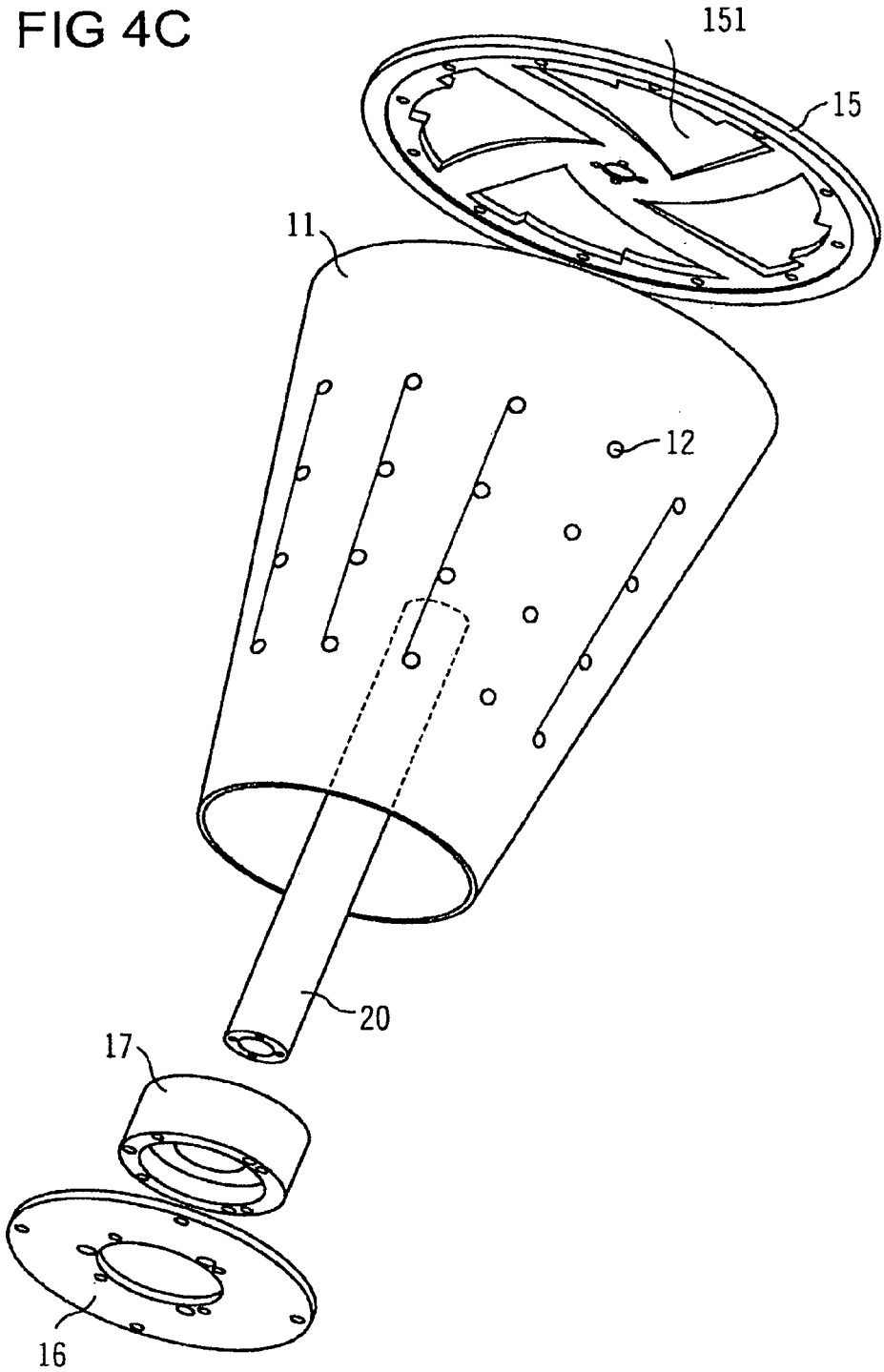

As can be gathered from FIG. 4C, a tube 20 can additionally be arranged between base 17 and cover plate 15, said tube being mechanically releasably connected, for example screwed, to the base 17 and the cover plate 15. The tube can be provided for example for receiving cables serving for electrically connecting the light emitting diodes 10.

The luminous means can have a diameter of between 18 and 24 cm, for example, at its base plate 16. At its cover plate 15, the luminous means can have, for example, a diameter of between at least 23 and at most 50 cm. In this case, the distance between base plate 16 and cover plate 15 can be from at least 27 cm to at most 42 cm. By way of example, eight light emitting diodes per heat sink 13 can be used in the luminous means. By way of example, six heat sinks 13 are inserted into a luminous means, such that the luminous means has six different luminous angles at which the emission characteristic of the generated light can be respectively different from one another. The dimensions of the luminous means indicated here constitute preferred exemplary embodiments. However, it is also possible—depending on the use requirements made of the luminous means—for luminous means to be made larger or smaller and with more or fewer light emitting diodes.

As illustrated in FIG. 4C, the luminous means 1 is assembled for example from the bottom, that is to say from the base plate 16, toward the top, that is to say toward the cover plate 15. Firstly, by way of example, the base 17 is screwed to the base plate 16. The tube 20 is then screwed onto the base. Afterward, the screen 11 having the perforations 12 is inserted into a groove at the base plate 16. The heat sinks 13 are then mounted at the cover plate 15 and the latter is fixed to the screen 11 by means of a groove. In addition, the cover plate 15 can be screwed to the tube 20. The heat sinks 13 can be mechanically releasably connected to the base 17 by screwing or by a press fit.

The heat sinks 13 are inserted for example from above through the cover for example onto cylindrical pins in the base 17. Furthermore, a circuit board can be fixed to the cover plate 15, to which circuit board the circuit boards 19 of each heat sink 13 are subsequently electrically connected. A cable—for example a ribbon cable—for connecting the circuit boards 19 can be drawn through the tube. The ribbon cable serves for electrically connecting the light emitting diodes 10 and is connected for example to ballasts 31 for driving the light emitting diodes.

Figure 5A:
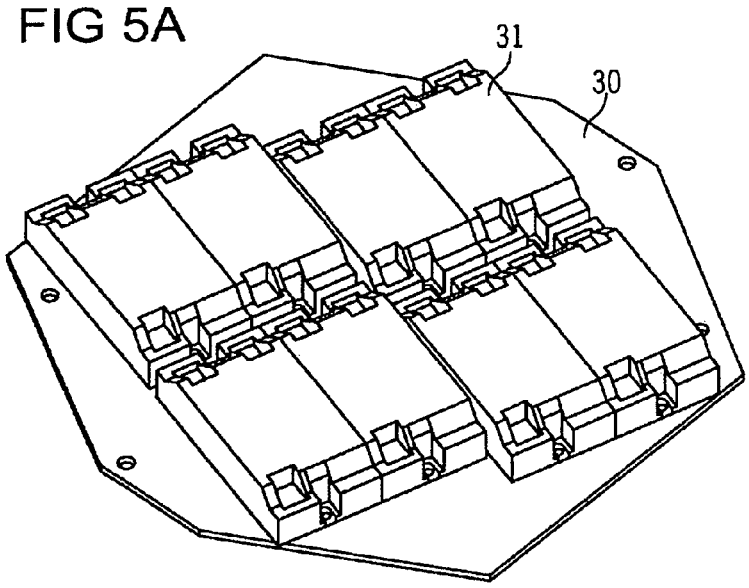

As is evident from FIG. 5A, the ballasts 31 can be arranged on a cover plate of the luminaire 100 (in this respect, also see FIG. 1).

Furthermore, it is possible for the ballasts 31 to be fixed to a bracket 32 to which the cover plate 30 of the luminaire is likewise fixed. Finally, however, it is also possible for the ballasts 31 for driving the light emitting diodes 10 to be arranged in the luminous means 1 itself, that is to say for example within the hollow body delimited by the screen 11 and the cover plate 15 and the base plate 16.

Figure 6:
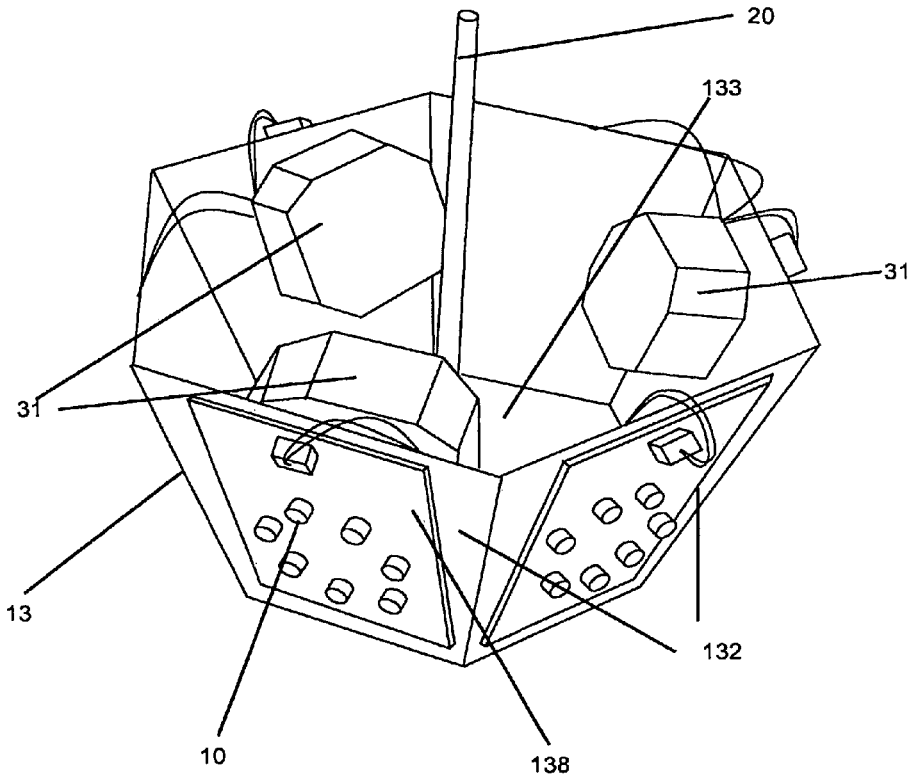

A further exemplary embodiment of a luminous means described here is explained in greater detail in conjunction with the perspective illustration on FIG. 6. The screen of the luminous means is not illustrated in FIG. 6.

Figure 5B:
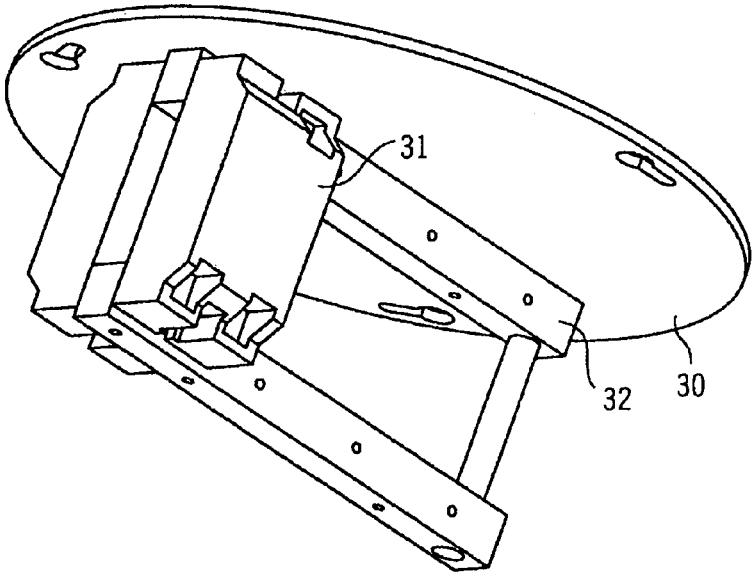

In accordance with the exemplary embodiment in FIGS. 5A and 5B, the luminous means has a heat sink 13 having a plurality of side areas 132, in the present case six side areas 132, for example. The side areas enclosing in the present case the volume of a truncated pyramid with a hexagonal base area. A connection carrier 138 is arranged at each of the side areas 132 in the region of the mounting area 14, said connection carrier being embodied as a circuit board. At that side of each connection carrier 138 which is remote from the side areas 132, light emitting diodes 10, respectively six light emitting diodes 10 in the present case, are fixed to the connection carrier 138 and electrically contact-connected.

Electrical and electronic components, for example ballasts 31, are arranged in the volume of the heat sink 13 that is enclosed by the side areas 132. In the present case, a common ballast 31 is assigned to respectively two connection carriers 138, said common ballast being connected to the assigned connection carriers by means of a plug connection. The ballasts 31 and, if appropriate, the further electrical and/or electronic components serve for the driving and power supply of the light emitting diodes of the luminous means.

In the present case, all the side areas 132 have the same angle of inclination with the base area 133. The side areas 132 are inclined by way of example by an angle of 30° from the normal to the base area 133.

In the luminaire (in this respect, cf. FIG. 1) in which the luminous means is used, the light emitting diodes 10 therefore emit their light in a main emission direction that is directed obliquely downward, for example toward a street. In this case, the position of the luminous means within the luminaire can be adjusted along the direction predetermined by the tube 20, such that the height of the luminous means above the street, for example, can be set.

The heat sink 13 of the luminous means can be produced in various ways. It is thus possible for the heat sink 13 to be embodied in integral fashion and to be injection-molded or transfer-molded, for example. The heat sink can then consist of a plastic material, in particular. Furthermore, it is possible for the side areas 132 and the base area 133 to be riveted to one another. The base area 133 and the side area 132 are then formed from a metal, for example. Furthermore, it is possible for the base area 133 and the side area 132 to be cut and/or stamped from a planar metal plate, for example a metal sheet. Afterward, the side areas 132 are then bent into the desired position and, if appropriate, welded, riveted or screwed to one another in order to increase the stability. The base area 133 and the side areas 132 are in this case embodied integrally with one another. Furthermore, it is possible for a respective hinge 137 to be formed between the side areas 132 and the base area 133, by means of which hinge it is possible to set the inclination of each side area relative to the base area.

Figure 7:
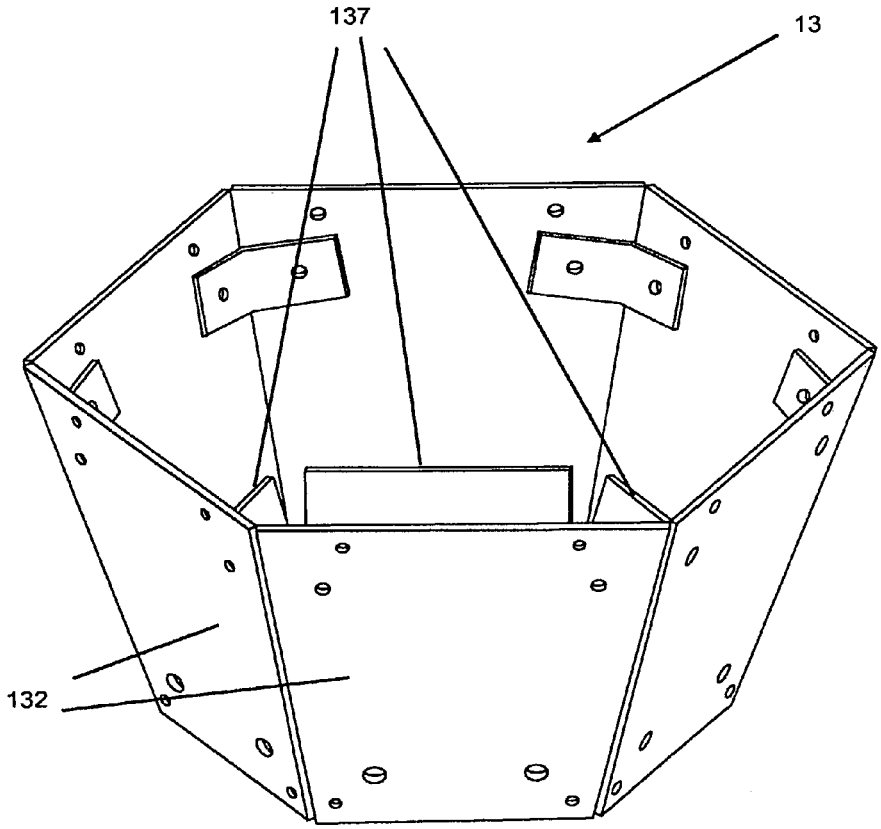

The schematic perspective illustration in FIG. 7 shows a heat sink 13 such as can be used for a luminous means described here. In the exemplary embodiment of FIG. 6, the side areas 132 are in each case connected to the base area 133 by means of a hinge 137, such that the angle of inclination of each side area 132 with respect to the base area 133 can be set individually. The side areas 132 can then be mechanically fixed by mutual screwing, riveting or welding.

Figure 8A:
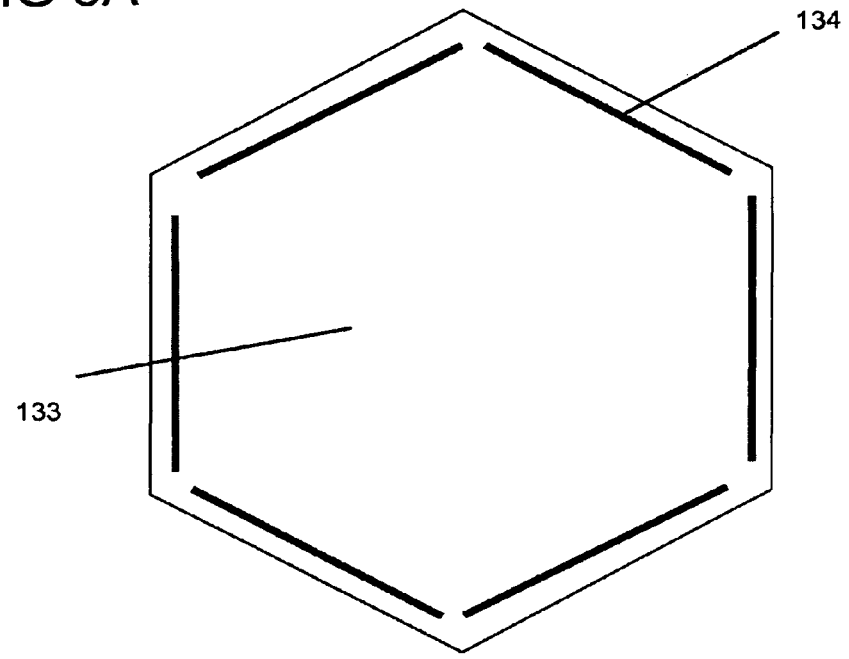
Figure 8B:
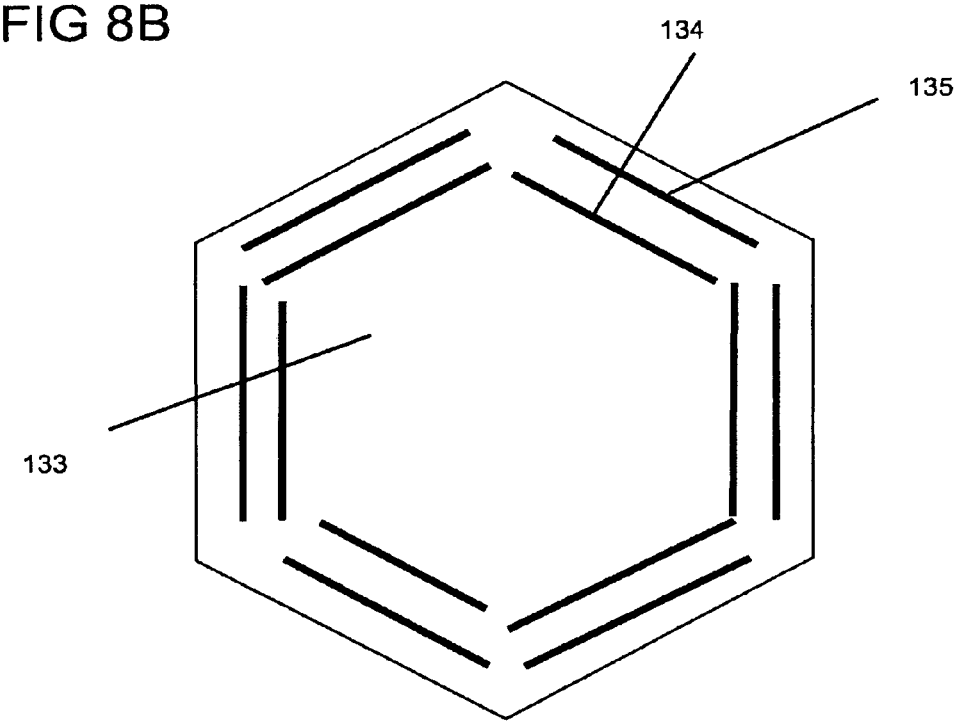
Figure 8C:
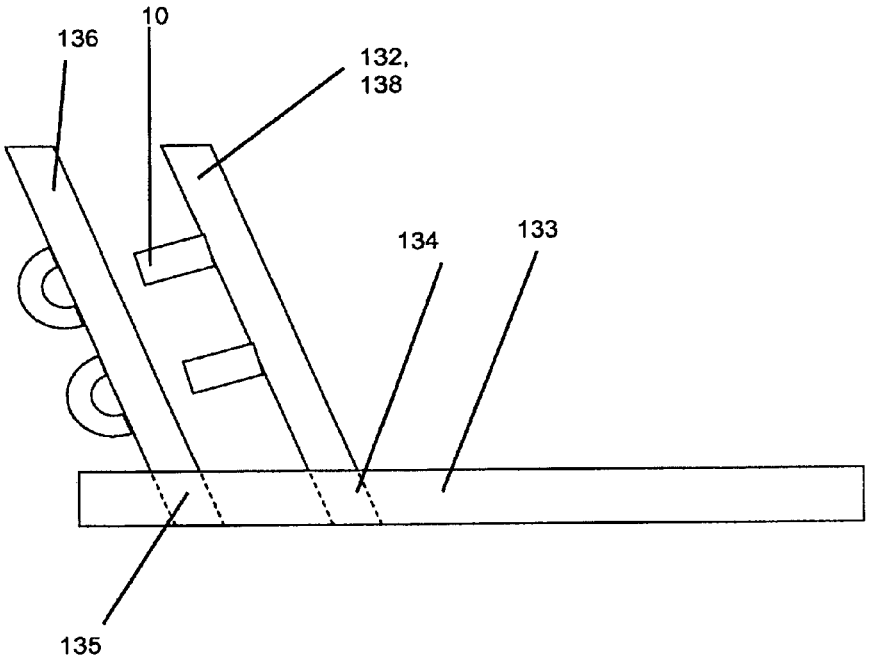

In conjunction with FIGS. 8A, 8B and 8C, a further possibility for securing or fixing the side areas 132 to the base area 133 is illustrated on the basis of schematic illustrations.

FIG. 8A shows a plan view of a base area 133 in which first cutouts 134 are arranged, which can each receive a side area 132. The first cutouts 134 are grooves into which the side areas 132 project in places. The side areas 132 are then mounted for example by plugging or latching hooks and, if appropriate, subsequent screwing.

The schematic plan view in FIG. 8B illustrates a base 133 having first cutouts 134 and second cutouts 135. The first cutouts 134 are once again provided for receiving side areas 132. Optical modules 136 (in this respect, cf. the schematic sectional illustration in FIG. 8C) are fixed into the second cutouts 135. Each optical module 136 comprises lenses, for example, wherein a lens can be assigned one-to-one to each light emitting diode 10. In this case, FIG. 8B also shows an exemplary embodiment of the luminous means wherein the side areas 132 are in each case formed by connection carriers 138.

FIG. 9 shows by way of example an axially symmetrical light intensity distribution such as is emitted for example by the luminous means from FIG. 6 during operation. An asymmetrical distribution of the light intensity can be set by means of different angles of inclination between the side areas 132 and the base area 133.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A lighting device comprising:

a plurality of light emitting diodes arranged in a manner distributed three- dimensionally; and a screen having at least one side facing said plurality of light emitting diodes, wherein said at least one side of said screen is formed from a radiation-absorbing material, wherein said screen encloses said plurality of light emitting diodes at least in places, wherein said screen has a plurality of perforations, wherein each of said plurality of light emitting diodes is assigned to one of said plurality of perforations on a one-to-one basis; and wherein each of said plurality of perforations is disposed downstream of a corresponding one of said plurality of light emitting diodes in a main emission direction such that at least 50% of light emitted by said corresponding one of said plurality of light emitting diodes during operation of the lighting device passes through said each of said plurality of perforations, further comprising at least one heat sink having at least two mounting areas, wherein at least one of said plurality of light emitting diodes is arranged at each of said at least two mounting areas, wherein said at least one heat sink has at least one side area, wherein said at least one side area comprises said at least two mounting areas, wherein at least one connection carrier facing said screen is fixed to each of said at least one side area of said heat sink, or each of said at least one side area comprises at least one connection carrier, wherein at least one of said plurality of light emitting diodes is mechanically fixed and electrically connected to each of said at least one connection carrier, wherein said at least one heat sink has a base area, to which said at least one side area of said at least one heat sink is fixed, and wherein said base area has at least one first cutout, wherein said at least one side area of said at least one heat sink projects into said at least one first cutout in places.

2. A lighting device comprising:

a plurality of light emitting diodes arranged in a manner distributed three-dimensionally;

a screen having at least one side facing said plurality of light emitting diodes, wherein said at least one side of said screen is formed from a radiation-absorbing material;

a plurality of heat sinks each having at least two mounting areas; and a base and a cover plate, wherein said screen encloses said plurality of light emitting diodes at least in places, wherein said screen has a plurality of perforations, wherein each of said plurality of light emitting diodes is assigned to one of said plurality of perforations on a one-to-one basis;

wherein each of said plurality of perforations is disposed downstream of a corresponding one of said plurality of light emitting diodes in a main emission direction such that at least 50% of light emitted by said corresponding one of said plurality of light emitting diodes during operation of the lighting device passes through said each of said plurality of perforations, wherein at least one of said plurality of light emitting diodes is arranged at each of said at least two mounting areas, and wherein said plurality of heat sinks are mechanically releasably connected with said base and said cover plate.

3. The lighting device of claim 2, further comprising at least one heat sink having at least two mounting areas, wherein at least one of said plurality of light emitting diodes is arranged at each of said at least two mounting areas.

4. The lighting device of claim 3, wherein said at least one heat sink has at least one side area, wherein said at least one side area comprises said at least two mounting areas, wherein at least one connection carrier facing said screen is fixed to each of said at least one side area of said heat sink, or each of said at least one side area comprises at least one connection carrier, and wherein at least one of said plurality of light emitting diodes is mechanically fixed and electrically connected to each of said at least one connection carrier.

5. The lighting device of claim 4, wherein said at least one side area encloses a volume in which at least one ballast for operating at least one portion of said plurality of light emitting diodes is arranged.

6. The lighting device of claim 3, wherein said at least one heat sink has a base area, to which said at least one side area of said at least one heat sink is fixed.

7. The lighting device of claim 6, wherein said base area has at least one first cutout, wherein said at least one side area of said at least one heat sink projects into said at least one first cutout in places.

8. The lighting device of claim 6, wherein said base area has at least one second cutout, wherein said at least one second cutout is arranged at a side of said at least one first cutout which faces said screen, and wherein said at least one second cutout is provided for receiving an optical module.

9. The lighting device of claim 8, further comprising an optical module, which projects into said at least one second cutout in places.

10. The lighting device of claim 4, wherein said at least one heat sink has a base area, to which said at least one side area of said at least one heat sink is fixed, and wherein each of said at least one side area is mechanically connected to neighboring side areas releasably in a nondestructive manner and/or said at least one side area and said base area are mechanically connected to one another releasably in a nondestructive manner.

11. The lighting device of claim 4, wherein said at least one heat sink has a base area, to which said at least one side area of said at least one heat sink is fixed, and wherein said at least one side area and said base area are connected to one another via a hinge.

12. The lighting device of claim 2, further comprising:

at least one heat sink having at least two mounting areas that are arranged in different planes, wherein a light emitting diode is arranged at each of said at least two mounting areas, and wherein said at least one heat sink has a staircase-like profile in a cross section and said at least two mounting areas are formed by treads of said staircase-like profile.

13. The lighting device of claim 4, wherein said at least one heat sink has a base area, to which said at least one side area of said at least one heat sink is fixed, said at least one side area includes two or more side areas, and wherein at least two of said two or more side areas form mutually different angles with said base area.

14. The lighting device of claim 2, wherein the light emitting diodes are arranged at a distance from the screen.

15. A lamp comprising at least one lighting device of claim 2.

16. A lighting device comprising:

a plurality of light emitting diodes arranged in a manner distributed three-dimensionally;

a screen having at least one side facing said plurality of light emitting diodes, wherein said at least one side of said screen is formed from a radiation-absorbing material; and at least one heat sink having at least two mounting areas, wherein said screen encloses said plurality of light emitting diodes, wherein said screen has a plurality of perforations, wherein each of said plurality of light emitting diodes is assigned to one of said plurality of perforations on a one-to-one basis, wherein each of said plurality of perforations is disposed downstream of a corresponding one of said plurality of light emitting diodes in a main emission direction such that at least 50% of light emitted by said corresponding one of said plurality of light emitting diodes during operation of the lighting device passes through said each of said plurality of perforations, wherein a light emitting diode is arranged at each of said at least two mounting areas, wherein said at least one heat sink has a staircase-like profile in a cross section and said at least two mounting areas are formed by treads of said staircase-like profile, and wherein said at least two mounting areas of said at least one heat sink are inclined with respect to one another such that light emitting diodes arranged at different mounting areas of said at least one heat sink have main emission directions that do not run parallel to one another;

further comprising a base and a cover plate, wherein said at least one heat sink includes two or more heat sinks, wherein each of said two or more heat sinks has a fixing lug having an opening, wherein each of said two or more heat sinks are screwed to said cover plate via said fixing lug and fixed to said base, and wherein said two or more heat sinks run from said base in a fan-like manner.

* * * * *